United States Patent [19]

Raney et al.

[11] Patent Number: 4,555,968

[45] Date of Patent: Dec. 3, 1985

[54] WEB FED DIE CUTTING PRESS HAVING AUTOMATIC 3-AXIS DIE REGISTRATION SYSTEM

[75] Inventors: Charles C. Raney, Kansas City; James T. Gramling, Basehor, both of Kans.

[73] Assignee: Preco Industries, Inc., Shawnee Mission, Kans.

[21] Appl. No.: 618,421

[22] Filed: Jun. 7, 1984

[51] Int. Cl.[4] ..... B26D 5/34

[52] U.S. Cl. ..... 83/209; 83/71; 83/210; 83/251; 83/365; 83/367; 83/368; 83/371

[58] Field of Search ..... 83/210, 209, 367, 368, 83/371, 251, 71; 250/548, 561, 557; 356/400, 401

[56] References Cited

U.S. PATENT DOCUMENTS

| | | | |
|---|---|---|---|
| 2,002,374 | 5/1935 | King . | |
| 2,078,669 | 4/1937 | King | 242/76 |
| 2,082,634 | 6/1937 | Johnstone . | |
| 2,777,069 | 1/1957 | Saeman | 250/219 |
| 2,962,596 | 11/1960 | Leimer et al. | 250/219 |
| 3,385,245 | 5/1968 | Ramsey et al. | 112/2 |
| 3,497,705 | 2/1970 | Adler | 250/237 |
| 3,535,527 | 10/1970 | Beall, Jr. | 250/209 |
| 3,539,260 | 11/1970 | Burch | 356/71 |
| 3,658,430 | 4/1972 | Rashkin | 356/172 |
| 3,683,195 | 8/1972 | Johannsmeier et al. | 250/219 DR |
| 3,758,784 | 9/1973 | Vischulis | 250/227 |
| 3,761,177 | 9/1973 | Corse | 356/23 |
| 3,766,355 | 10/1973 | Kottkamp | 219/121 EB |
| 3,796,497 | 3/1974 | Mathisen et al. | 356/152 |
| 3,840,739 | 10/1974 | Coulter . | |
| 3,859,517 | 1/1975 | Okuma | 250/202 |
| 3,868,555 | 2/1975 | Knowles | 318/577 |
| 3,919,560 | 11/1975 | Nopper | 250/557 |
| 3,919,561 | 11/1975 | Coberley | 250/561 |
| 3,966,329 | 6/1976 | Dickey | 356/152 |
| 4,053,250 | 10/1977 | Justice | 408/3 |
| 4,059,841 | 11/1977 | Bricot et al. | 358/128 |
| 4,085,928 | 4/1978 | Sussman | 270/61 R |
| 4,089,242 | 6/1978 | Gramling | 83/95 |
| 4,109,158 | 8/1978 | Blitchington et al. | 250/548 |
| 4,110,627 | 8/1978 | Isherwood | 250/561 |
| 4,146,797 | 3/1979 | Nakagawa | 250/548 |
| 4,151,451 | 4/1979 | Maertins et al. | 318/568 |
| 4,315,201 | 2/1982 | Suzuki | 318/640 |
| 4,354,404 | 10/1982 | Renusino | 82/2 D |
| 4,356,223 | 10/1982 | Iida | 428/156 |
| 4,376,584 | 3/1983 | Hart et al. | 356/401 |
| 4,406,949 | 9/1983 | Sophnheimer | 250/548 |
| 4,419,013 | 12/1983 | Heimer | 356/400 |

*Primary Examiner*—Donald R. Schran

*Attorney, Agent, or Firm*—Schmidt, Johnson, Hovey & Williams

[57] ABSTRACT

A die cutting press for processing web material is disclosed which is operable to provide very precise alignment of a reciprocable die cutting unit with each successive area of the web to be die cut. In operation, the web is incrementally advanced toward the work station of the press until the area next to be die cut is substantially but not exactly in the die cut position thereof. The web feed is then placed in a creep mode to advance the web until an optical sensor determines the presence of transverse alignment indicium on one side of the web. Mechanism is thereupon actuated to rotate the die unit as required to bring the die assembly into alignment with related indicium on the opposite side of the web while effecting shifting of the web longitudinally thereof in a direction of travel as necessary to maintain die registration with the first sensed web indicium. Structure then shifts the die unit laterally of the web at the work station as required to bring the die unit into precise registration with longitudinally extending indicium on one side of the web. Only then is a defined area of the web subjected to the die cut unit. A cushion of air is provided for supporting the die unit while it is being rotated, during longitudinal shifting thereof in the creep mode, and as lateral shifting is accomplished with respect to the web. Extremely accurate is thereby accomplished registration of the die unit with the plurality of indicia associated with each area of the web subjected to the die cutting operation. Sensing of the presence or absence of alignment indicia on the web is preferably carried out through the use of photooptical devices associated with light transmitting flexible glass fiber bundles that direct light to the web as well as the light reflected therefrom back to the sensor mechanism. A microprocessor receives inputs from phototransistors to control operation of the die alignment and web advancement mechanism.

20 Claims, 16 Drawing Figures

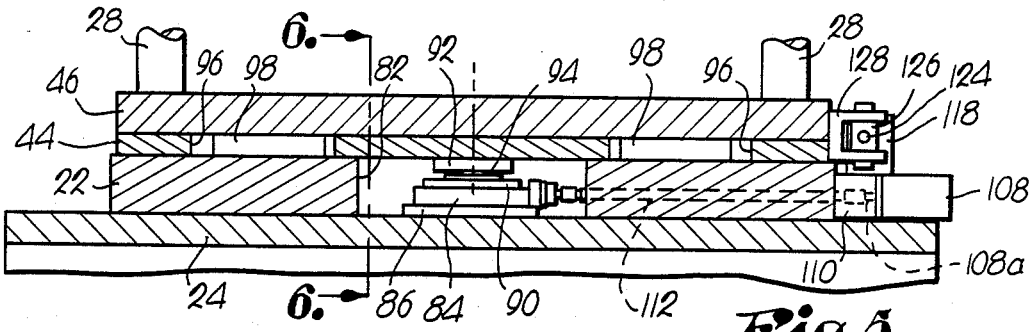
Fig.5.
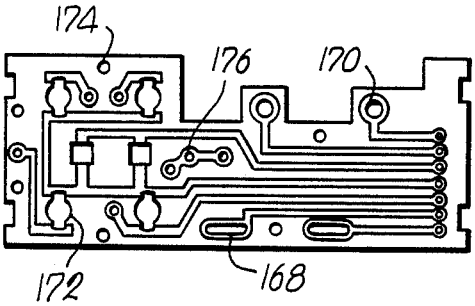
Fig.7.
Fig.9.
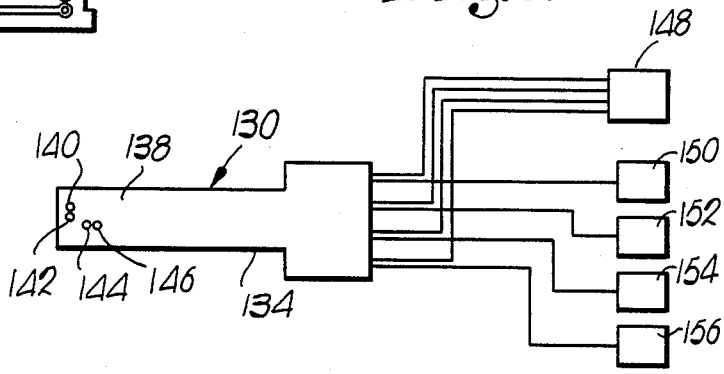
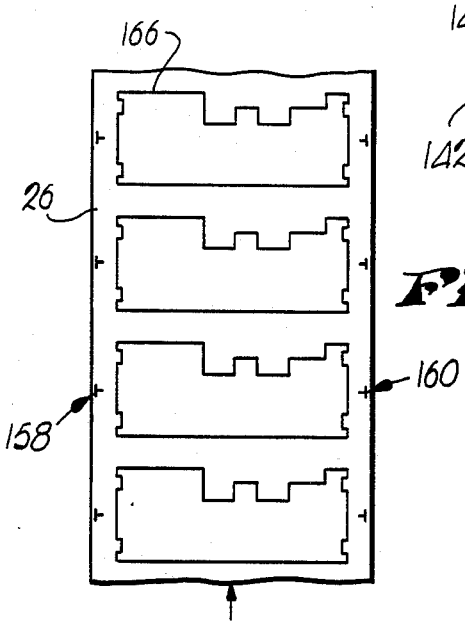
Fig.8.
Fig.10.
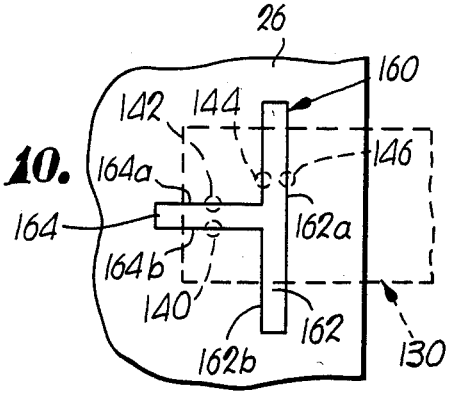
Fig.11.
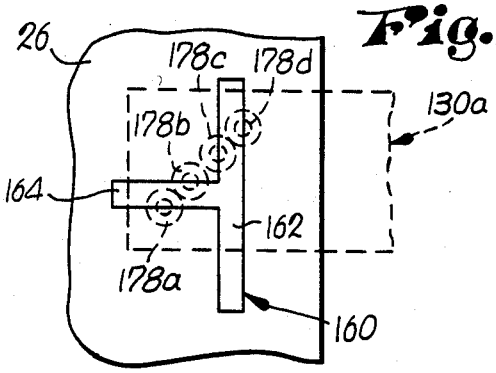
Fig.6.
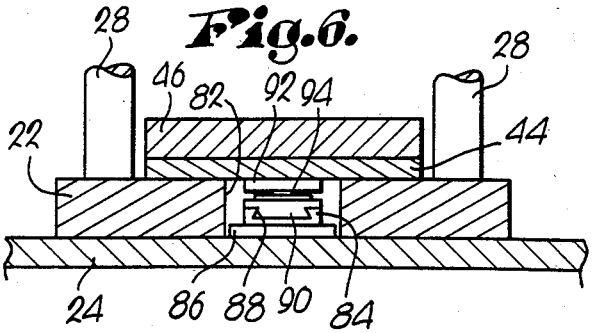

WEB FED DIE CUTTING PRESS HAVING AUTOMATIC 3-AXIS DIE REGISTRATION SYSTEM

BACKGROUND OF THE INVENTION

1. Field of the Invention

This invention relates to a web fed die cutting press having a reciprocable ram wherein the web is incrementally shifted to bring each area of the web to be die cut to a work station and mechanism is provided for bringing the web longitudinally thereof along what may be called the X axis into alignment with indicium on the web, for rotating the die unit about an axis defined as $\theta$, and for shifting the die unit laterally of the web along a Y axis to assure precise registration of the die unit with an area of the web to be die cut, before the ram is shifted to effect die cutting of the defined aea of the web.

2. Description of the Prior Art

The prior art has not provided efficient die cutting presses which are effective to align a die unit with a defined area of web to be die cut on an extremely precise basis without sacrifice in the speed of operation of the press, while at the same time affording essentially automatic operation.

Die cut presses have heretofore been provided which in effect constitute sheet fed units with alignment indicia being read by sensor mechanism forming a part of the press and wherein the work sheet is shifted as required to bring an image thereon into proper registration with the die assembly. As can be appreciated though, it is usually not feasible to shift a web located at the work station of the die cut press in order to bring an image on the web into alignment with the die cut unit without first severing the area of the web next to be die cut from the web itself. For various reasons, this is not a desirable mode of operation, especially where the die cut areas of the web are to be knocked out at a station spaced from and independent of the work station of the die cut press.

It is also known to provide positioning systems which sense the disposition of an article relative to a sensor which are functional to very accurately locate the work piece with respect to two coordinate axes. For example, in the Heinz U.S. Pat. No. 3,207,904, an electro-optical positioning system is disclosed which is capable of providing both translational and rotational positioning of an article. The system is especially useful for positioning semi-conductor wafers during production of transistors where bonding of conductive leads to the wafer must be carried out on an extremely accurate basis. However, the Heinz system is not practical for accurate positioning of images to be die cut forming a part of an elongated web, absent severing of the individual image sections from the web prior to die cut thereof.

Registration assemblies have also heretofore been provided for controlling the positioning of webs, but these mechanisms have not incorporated interrelated components for effecting registration on X, Y and $\theta$ axes. In U.S. Pat. No. 3,919,561, fiber optics and photocells are used to sense marks on a web in the form of a transverse bar and an angled bar, but the assembly cannot provide accurate positioning of a die unit as accomplished in the present invention because of lack of provision for rotation of the die unit about the $\theta$ axis while maintaining the image area of the web to be die cut in proper alignment with a die cut unit.

Another optical readout system is discloed for example in U.S. Pat. No. 4,059,841 which uses four photocells in a square pattern to read information recorded as marks along a track but here again the system is not operable to register images on a web to be die cut by a combination of web movement and die unit rotation and lateral shifting to obtain precise registration of the die unit with the web before die cutting thereof.

U.S. Pat. No. 3,758,784 discloses an optical detecting head where a line or edge sensor depends on the provision of fiber optics and four photocells are arranged in a line transverse to an article mark or edge being sensed to indicate the location of the article relative to the sensor. This is an example of accurate registration mark sensing but not exemplary of article and die registration combining shifting of a web, and shifting and rotation of the die.

An automatic positioning system is shown in U.S. Pat. No. 4,151,451 which functions to control X and Y axes movement of a work piece carrying table which are shifted by respective servo-motors. Indicia on the work piece are appropriately sensed and the signals resulting therefrom employed to control shifting of the table. Movement of the tool is possible but no rotation of a die unit or the like in coordination with longitudinal shifting of the work piece was contemplated by the inventor.

Fiber optic position sensing and recording mechanism is set out in U.S. Pat. No. 3,658,430 but the signals produced are not used to adjust the disposition of a work piece.

U.S. Pat. No. 3,385,245 embodies photocell position sensing to control longitudinal advancement of a web. Four photocells spaced around a sewing machine needle sense the edge of the cloth to provide digital control signals which are connected to stepping motors that move a table carrying the work piece. Adjustment of the table is possible along X and Y axes. No rotation of a tool about a $\theta$ axis is provided.

U.S. Pat. Nos. 2,002,374 and 4,085,928 illustrate the use of photocell sensing (and in the case of the '928 patent the provision of fiber optics) of markings on a moving work piece to actuate a machine tool as in the '374 patent or a folding mechanism as in the '928 patent.

U.S. Patents which illustrate the use of photocell sensing generally, and in some instances with associated fiber optics, for lateral guidance of traveling webs in response to the sensing of either the edge of a web or a line or marks therealong include: Nos. 2,078,669; 2,082,634; 2,777,069; 2,962,596; 3,859,517; 3,919,560; 4,110,627; and 4,146,797.

The use of guide or registration marks for the alignment of a mask with a work piece, such as in the manufacture of integrated circuits is disclosed in U.S. Pat. Nos. 3,497,705, 3,683,195 and 3,796,497.

U.S. Pat. No. 4,109,158 suggests the use of photocells for controlling positioning of a flexible printed circuit board carrying work piece. Alignment of the board with a mask is accomplished by photocell sensing of light through X-axis extended and Y-axis extended slots as contrasted with sensing of imprinted markings. There is no teaching of X, Y and $\theta$ axes alignment of a die unit with images on a web to be die cut.

Devices which incorporate X and Y axes positioning of relatively movable objects by mechanism which is dependent on photocell sensing of patterns, fiber optic light guides and similar mechanisms are found in U.S.

Pat. Nos. 3,385,244; 3,535,527; 3,539,260; 3,761,177; 3,840,739; 3,868,555; and 3,966,329.

Other noteworthy U.S. Pat. includes No. 4,406,949 which suggests apparatus for scanning a work piece for reference points thereon using electronic circuits wherein a laser beam is directed downward onto a wafer containing an integrated circuit die provided with targets which are sensed by the beam to provide die orientation; Pat. No. 4,376,584 wherein a circuit pattern printing system includes alignment apparatus for adjusting a printing mask; Pat. No. 4,053,250 wherein a work table is adjusted by a pneumatic logic circuit; Pat. No. 4,315,201 disclosing apparatus for aligning a mask and wafer each having alignment marks wherein the amount of relative deviation between the alignment marks on the mask and wafer is sensed and a reading effected only after coincidence is photoelectrically detected; Pat. No. 4,354,404, wherein the carriage of a machine tool is movable relative to a work piece by position sensing means; and Pat. No. 4,356,223, wherein a cross-shaped semi-conductor chip registration mark is used for precise positioning of the chip relative to a tool.

U.S. Pat. No. 4,089,242 discloses a method and apparatus for forming gaskets and the like which is capable of operating at faster speeds than die cut presses theretofor available but the unit does not have X, Y and $\theta$ axes registration of a die unit with preprinted images or other predetermined areas of the web to be successively die cut.

SUMMARY OF THE INVENTION

A die cutting press is provided for web material having indicia on opposite, longitudinally-extending sides thereof associated with each defined area of the web to be die cut. The press is especially useful for die cutting a web wherein the indicia on opposed sides of the web are related to a particular defined web area each of which has a segment that extends transversely of the web and at least one of the opposed, related indicia has a section disposed longitudinally of the web.

The press includes power operated ram means shiftable toward and away from a base platen which supports a die cut unit cooperable with the ram to receive a web therebetween at a press work station. The die cut unit is mounted on the base platen in disposition for rotation about an upright axis as well as for shifting transversely of the path of travel of a web through the press. Three separate servo-motor mechanisms are provided for individually advancing the web in a creep mode after an image to be die cut is adjacent the die cut position of the work station, for rotating the die unit about the referenced upright axis and for shifting the die unit laterally of the web.

First sensing means movable with the die unit has sensors positionable to sense the presence of indicia on one side of the web. This sensing means is functional to determine the presence of a segment of an indicium on the web which first presents itself to the sensor as the web is moved by feeding means therefor through a displacement to bring the next image bearing area of the web to the press work station. Means controlled by such first sensing means is coupled to the web feeding means and to the die rotating means for effecting rotation of the die unit to an extent as may be necessary and in a direction to bring the segment of an opposed indicium related to the indicium segment first sensed by the first sensing means during movement of the next to be processed area of the web to the work station, into a location where such opposed, related segment is sensed as being present by the first sensing means. Operation of the web feeding means is continued in a direction to move the web longitudinally of the length thereof as may be required to maintain the presence sensing relationship between the first sensing means and the segment of the web indicium which was first sensed by the first sensing means as the next to be processed area of the web is moved to the press work station.

Second sensing means movable with the die unit has sensors positioned to sense the presence and relative position to the second sensing means of the web indicium section associated with the next to be processed area of the web. Means controlled by the second sensing means is operably coupled to the lateral die unit shifting means in a manner to effect shifting of the die unit transversely of the web to an extent as may be necessary to bring the section of a corresponding web indicium into predetermined relative relationship to the die unit. Only after registration of the die unit with the image of the web at the work station is the power operated means actuated to bring the die unit into functional engagement with the web.

It is therefore apparent that the next to be processed area of the web is accurately aligned relative to the die unit with the web being shifted longitudinally thereof along a X axis, the die unit rotated about an axis $\theta$, and the die unit also moved laterally the web as required to assure very precise alignment between the die unit and an image on the web to be subjected to the die assembly.

In its preferred form, means is provided for floating the die unit on a cushion of air so that the die unit may be maintained in close relative relationship to the web while the latter is advanced and the die unit is rotated and laterally shifted, thus decreasing the tolerances involved in precise sensing of the locations of the registration indicia on the web. The precision of registration at high operating speeds is maintained by a unique combination of fiber optics, photoelectronics and microprocessing. In operation, the system is capable of automatically aligning images on a web with the die unit to a tolerance of $\pm 0.0005$ inch.

BRIEF DESCRIPTION OF THE DRAWINGS

FIG. 5 is a vertical cross-sectional view on the line 5—5 of FIG. 4 and looking in the direction of the arrows;

FIG. 6 is a vertical cross-sectional view on the line 6—6 of FIG. 5 and looking in the direction of the arrows;

FIG. 7 is a plan view of a typical part to be die cut from a web processed with the present press and illustrating the complexity often encountered in die cutting operations including exterior and interior lines that must be cut as well as holes, slots and other apertures formed in the part;

FIG. 8 is a fragmentary plan view of a web having images thereon corresponding to that illustrated in detail in FIG. 7 and showing T-shaped indicia associated with each of the images to be die cut;

FIG. 9 is a simplified schematic showing of one of the fiber optic and photoelectronic systems embodied in the present press;

FIG. 10 is a fragmentary, enlarged view showing the interrelationship between one of the fiber optic sensors and a T-shaped indicia on the web when the indicia is properly aligned with the sensor;

FIG. 11 is a fragmentary, enlarged view similar to FIG. 10 but showing an alternate sensor for determining the presence or absence of a T-shaped indicia on the web as well as the position of such indicia relative to the sensor;

DETAILED DESCRIPTION OF A PREFERRED EMBODIMENT

Figure 2:
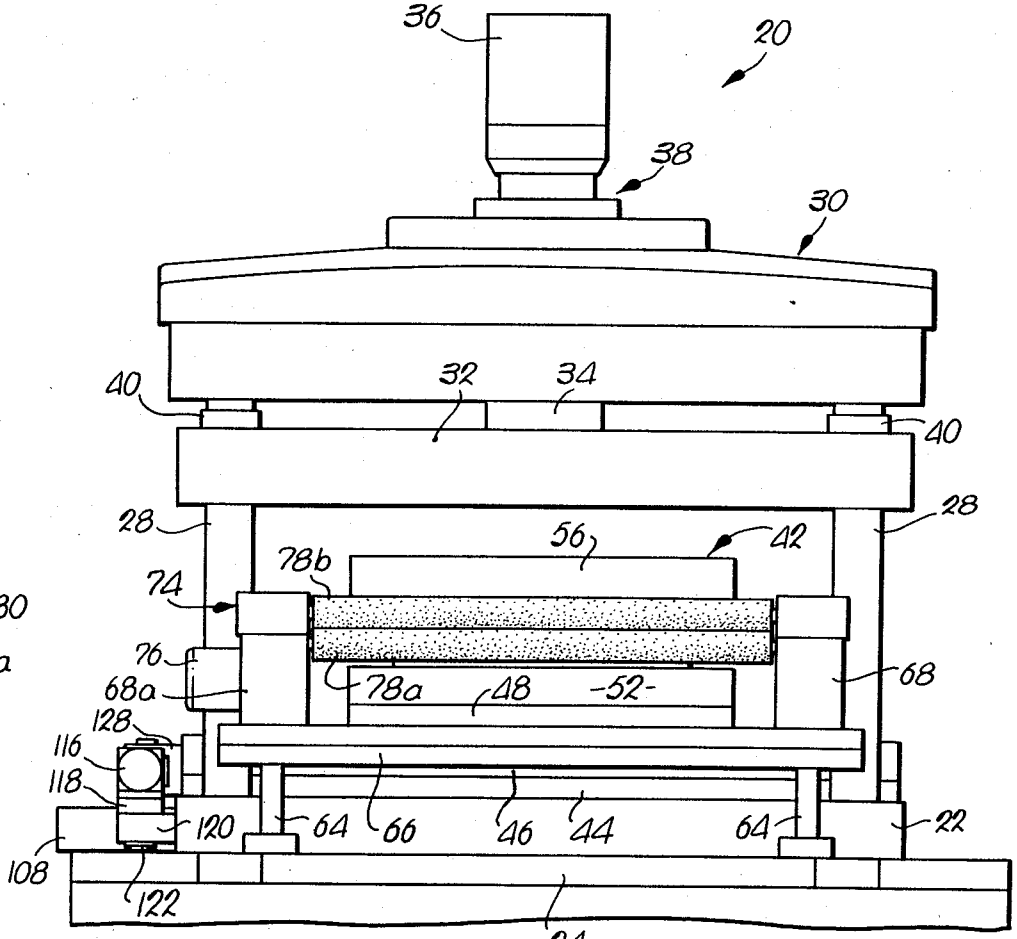
FIG. 2 is an end elevational view from the infeed end of the press as illustrated in FIG. 1.

Press 20 includes a base platen 22 carried by a horizontal support member 24 forming a part of the overall machine. As is apparent from FIGS. 1–3, base platen 22 is of relatively thick metal stock that serves as a die unit carrier operable to process a web 26 (FIG. 3) fed to the press. In the context of the present invention, the term web is used generically to define any length of material having more than one image thereon to be successively subjected to a die cutting operation. This would include therefore, rolls of material as well as sheet stack having more than one image in successive order.

Four upstanding rods 28 project upwardly from respective corners of platen 22 and support an upper frame assembly 30. Ram platen 32 reciprocably carried by rods 28 below assembly 30 depends from a piston 34 of piston and cylinder assembly 38 located vertically in frame assembly 30. A micrometer unit 36 mounted on the top of assembly 30 and operably joined to the piston and cylinder assembly 38 permits selective adjustment of the length of stroke of rod 34 and thereby the extent of vertical shifting of the ram platen 32. It is to be understood in this respect that suitable bearings 40 secured to ram 32 and surrounding rods 28 restrict reciprocation of the ram 32 to a vertical path of travel while the underface of such ram remains in a horizontal position.

The die unit broadly designated 42 and made up of a die assembly and a punch assembly defining a press work station is positioned on and carried by the base platen 22. The lower plate 44 of die unit 42 is directly engageable with the upper surface of base platen 22 while an upper plate 46 is mounted directly above plate 44. As is best evident from FIG. 1, a pair of horizontally spaced, opposed end spacers 48 cooperate with blocks 50 to provide peripheral support for die holder 52. The die assembly 54 is mounted directly on the die holder 52. The punch holder 56 yieldably supported on die holder 52 by a series of corner located pin and spring guide means 58 carries a punch assembly 60 on the underside thereof. The dies used in press 20 should be of the independent free floating type which have their own interval springs to return the punch holder 56 after the blanking operation. It is to be noted that no part of the die unit 42 is affixed to the ram 32 of the press 20 which functions solely as a force transmission device.

Figure 1:
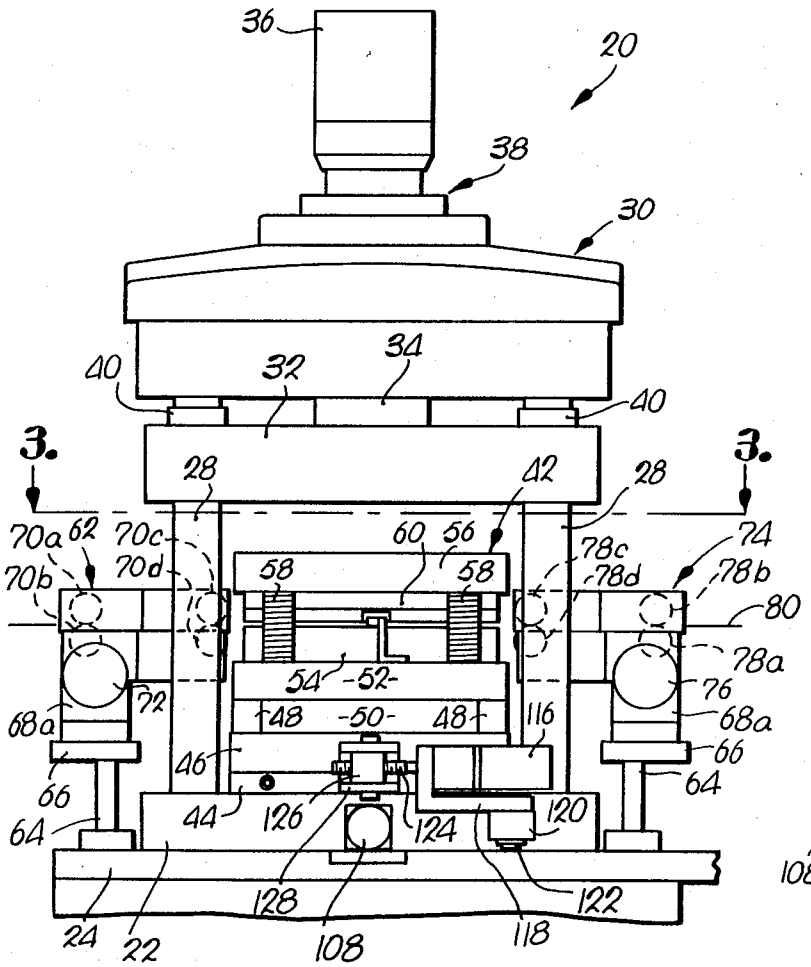
FIG. 1 is a side elevational view of a die cutting press constructed in accordance with the preferred embodiment of the invention and illustrating the platen, a power operated ram, a die unit carried by the ram, servo-motors for advancing a web, rotating the die unit and shifting the latter laterally of a web.
Figure 3:
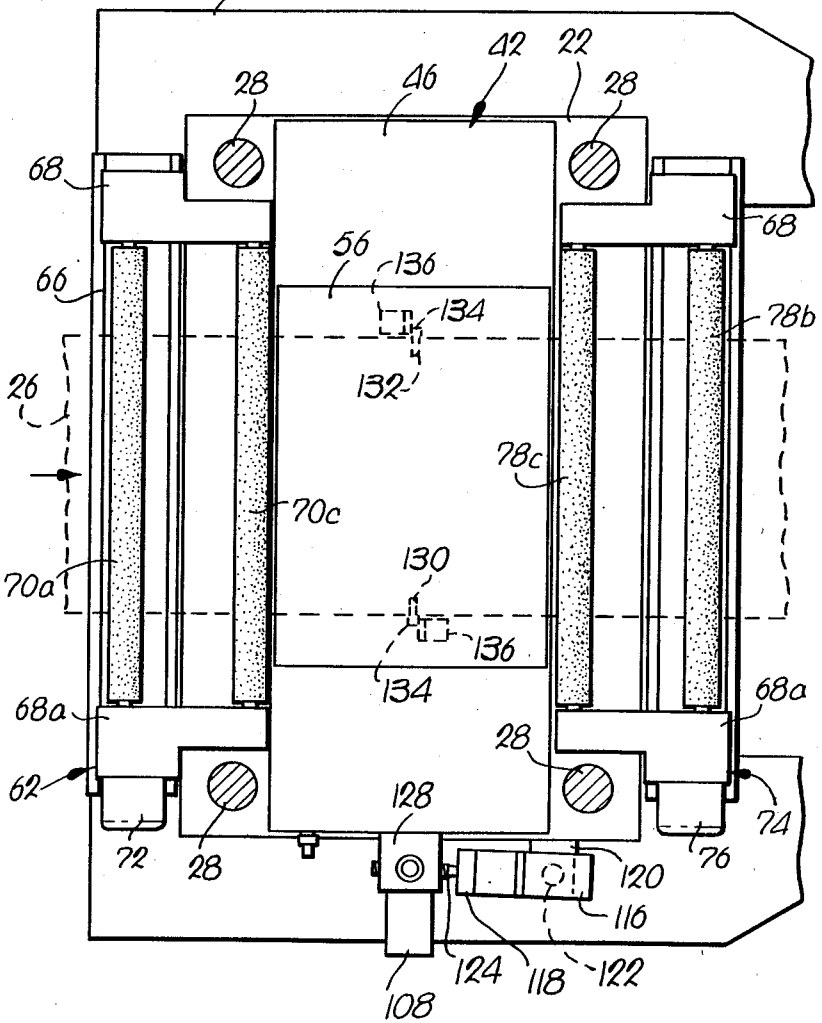
FIG. 3 is a horizontal cross-sectional view taken substantially on the line 3—3 of FIG. 1 and illustrating the sensors of the first and second sensing means, as well as the web, in phantom lines.

Viewing FIGS. 1–3, the web infeed mechanism 62 shown on the left-hand side of the press 20 as depicted in FIG. 1, includes a pair of upright stanchions 64 which carry a horizontal support plate 66. Bearers 68 at opposite ends of mechanism 62 support two pairs of horizontally spaced, vertically aligned infeed rollers, the first vertical pair being designated 70*a* and 70*b* while the second vertical pair are 70*c* and 70*d* respectively. The lower roller 70*b* is driven directly by a DC powered, X-axis servo-motor 72 carried by the bearer 68*a* while the adjacent lower roller 70*d* is rotated at the same speed through the medium of a timing belt therebetween within the housing of bearer 68*a*. It can be seen from FIG. 1 that the nip between rollers 70*a* and 70*b* is horizontally aligned with the nip between the rollers 70*c* and 70*d*.

The web outfeed end of press 20 has web drive mechanism 74 which is identical with infeed mechanism 62 and thus need not be described in detail although it is to be understood that the DC X-axis servo-motor 76 is wired in parallel with motor 72. Consequently, the lower driven rollers 78*a* and 78*c* are caused to rotate at the same speed as rollers 78*b* and 78*d*. Similarly, the nips between rollers 78*a* and 78*b* and between rollers 78*c* and 78*d* are horizontally aligned with the nips between rollers 70*a* and 70*b* as well as 70*c* and 70*d*. Thus, the path of travel of web 26 through press 20 as shown in FIG. 1 is essentially along horizontal line 80.

It is to be appreciated that the lower plate 44 along with the upper plate 46 secured thereto function as a bolster for supporting the die assembly of the press. Viewing FIGS. 4 and 5, it is to be seen that the base platen 22 has a central rectangular opening 82 therein oriented with the longest axis thereof transverse of press 20. A channel-shaped block element 84 supported on the upper surface of member 24 within opening 82 through the medium of a spacer 86 has a frustoconical groove 88 therein which extends transversely of press 20. A slide 90 complementally positioned in groove 88 of channel block element 84 supports a rotatable support member 92 secured directly to the underside of lower plate 44 (see FIG. 5). The support member 92 is rotatable with respect to the underlying block 90 through the medium of pivot mechanism 94. One feature of mechanism 94 is the fact that the bearing forming a part thereof allows support member 92 and thereby the components resting thereon (upper and lower plates 44, 46, die holder 52 and die assembly 54 and punch assembly 56 carried thereby) to shift vertically through a limited displacement (in the order of 1/32 inch) without permitting the components carried by such rotatable mechanism to shift laterally.

Figure 4:
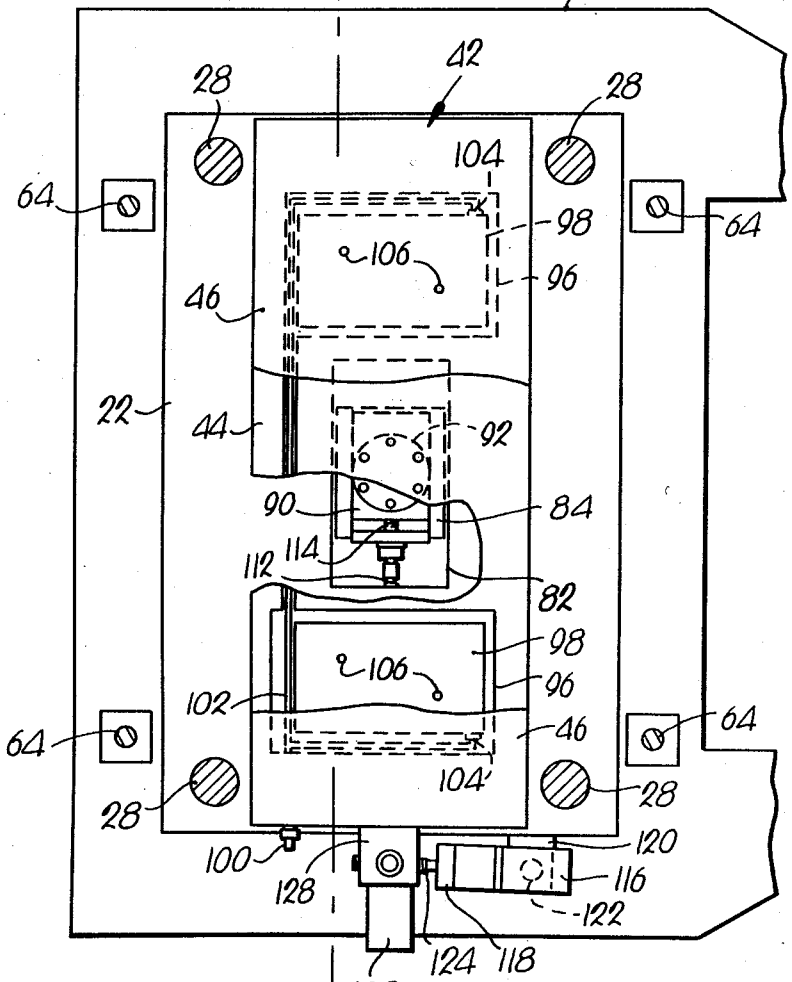
FIG. 4 is a horizontal cross-sectional view on essentially the same line as 3—3 but with parts being broken away and in section to reveal constructional features of the press.

Lower plate 44 has two spaced, rectangular openings 96 therein which clear corresponding rectangular air bearings 98 oriented with the series of air outlet ports thereof disposed downwardly in facing relationship to the upper surface of platen 22. Useful air bearings in this respect have been found to be those sold by C & H Precision Tool, Inc., Long Island, N.Y. under the trade designation "Flying Carpet", Model B. The air supply conduit 100 for bearings 98 is illustrated in FIG. 4 and is threaded into a suitable port in plate 44 which communicates with tubing 102 recessed in plate 44 and in parallel communication with the inlets 104 of each of the bearings 98. The air bearings 98 are secured by pins 106 to upper plate 46 to maintain each of the bearings in proper spatial disposition within corresponding rectangular openings 96. It is to be understood in this respect that the downwardly facing airbleed orifices in the bottom surfaces of bearings 98 are of relatively small diameter and serve to create a relatively uniform layer of air between respective bearings and the upper face of platen 22 when air control means is actuated to allow air under pressure to be directed to the bearings.

Means for effecting shifting movement of the block 90 in the channel-shaped groove 88 includes a Y-axis DC servo-motor 108 (FIGS. 1, 2, 4 and 5) mounted on the outer face of platen 22 through the medium of a hollow mounting block 110 in disposition such that the output shaft 108*a* thereof is directly aligned with the block 90. Shaft 112 extending through a suitable passage therefor in the platen 22 is joined to the outer end of motor shaft 108*a* for rotation thereby. The innermost end of shaft 112 is coupled to a lead screw 114 threaded into slide block 90. Operation of motor 108 effects rotation of shaft 112 and thereby lead screw 114 connected thereto to shift slide 90 in channel block 84 depending upon the direction of rotation of the motor 108.

Another DC servo-motor 116 referred to as the $\theta$ axis motor and carried by platen 22 adjacent Y-axis motor 108 is supported by an L bracket 118 pivotally connected to an extension 120 projecting from a side face of platen 22. It is apparent from FIGS. 1 and 4 that bracket 118 and thereby the motor 116 mounted thereon are pivotal about the axis of upright pin 122. The shaft 124 of motor 116, threaded in the outer end thereof, is threadably received within pivot block 126 rotatably carried by U bracket 128 oriented with the legs thereof facing outwardly as depicted in FIGS. 1–5. The bight portion of U bracket 128 is secured to plates 44 and 46 so that upon rotation of shaft 124 by motor 116, die unit 42 is rotated about an upright axis through rotatable support member 92.

First and second sensing means are provided in association with the die unit 42 and include first and second sensors 130 and 132 respectively as shown by dashed lines in FIG. 3. For orientation purposes, and viewing FIGS. 12 and 15 to be described in detail hereinafter, the sensor 132 is located to the left of the web 26 as the latter moves left to right of FIG. 1 and from the top to the bottom of the drawings of FIGS. 12–15 inclusive while sensor 130 is on the right side of the web.

Each of the sensors 130 is made up of a metal block 134 supported by a bracket 136 in turn carried by a corresponding face of lower die holder 52. Desirably, the block 134 is adjustably mounted on a respective bracket 136, or in the alternative, the bracket with a corresponding block 134 thereon is adjustably secured to a respective surface of die holder 52.

As best shown schematically in FIG. 9 depicting sensor 130, the flat face 138 of respective block 134 which normally faces downwardly in proximal relationship to a web 26 moving along path 80, is disposed in essentially a horizontal position. Each block 134 serves as a support for four sets of fiber optic bundles 140, 142, 144 and 146. The bundles 140 and 142 form one associated pair while bundles 144 and 146 define a second associated pair. The exposed end of fiber optic bundle 140 illustrated in FIG. 9 is strategically located relative to the exposed end of fiber optic bundle 142 such that a line therebetween is intended to be essentially parallel to the longitudinal length of web 26 traveling through press 20. Similarly, a line between the exposed ends of bundles 144 and 146 is perpendicular to the line between bundles 140 and 142 and the ends of bundles 144 and 146 are located inboard of the exposed ends of bundles 140 and 142.

A series of flexible light transmitting glass fibers make up each of the bundles 140–146 inclusive. Certain of such glass fibers act as light transmittors leading from a light source 148 located remotely of the die assembly to each of the exposed ends of bundles 140–146 inclusive. Certain other glass fibers of each bundle function as light receptors leading from the exposed ends thereof to light responsive means in the nature of phototransistors 150, 152, 154 and 156 operably associated with respective bundles 140–146 respectively.

Sensor 132 is similar to the sensor 130 except that it does not include fiber optic bundles equivalent to 144 and 146. Accordingly, the sensor 132 has only fiber optic bundles 140 and 142 leading to associated phototransistors such as 150 and 152, although it is to be understood in this respect that certain of the glass fibers making up the bundles 140 and 142 of sensor 132 do extend from light source 148 to the exposed ends of such bundles.

Figure 16:
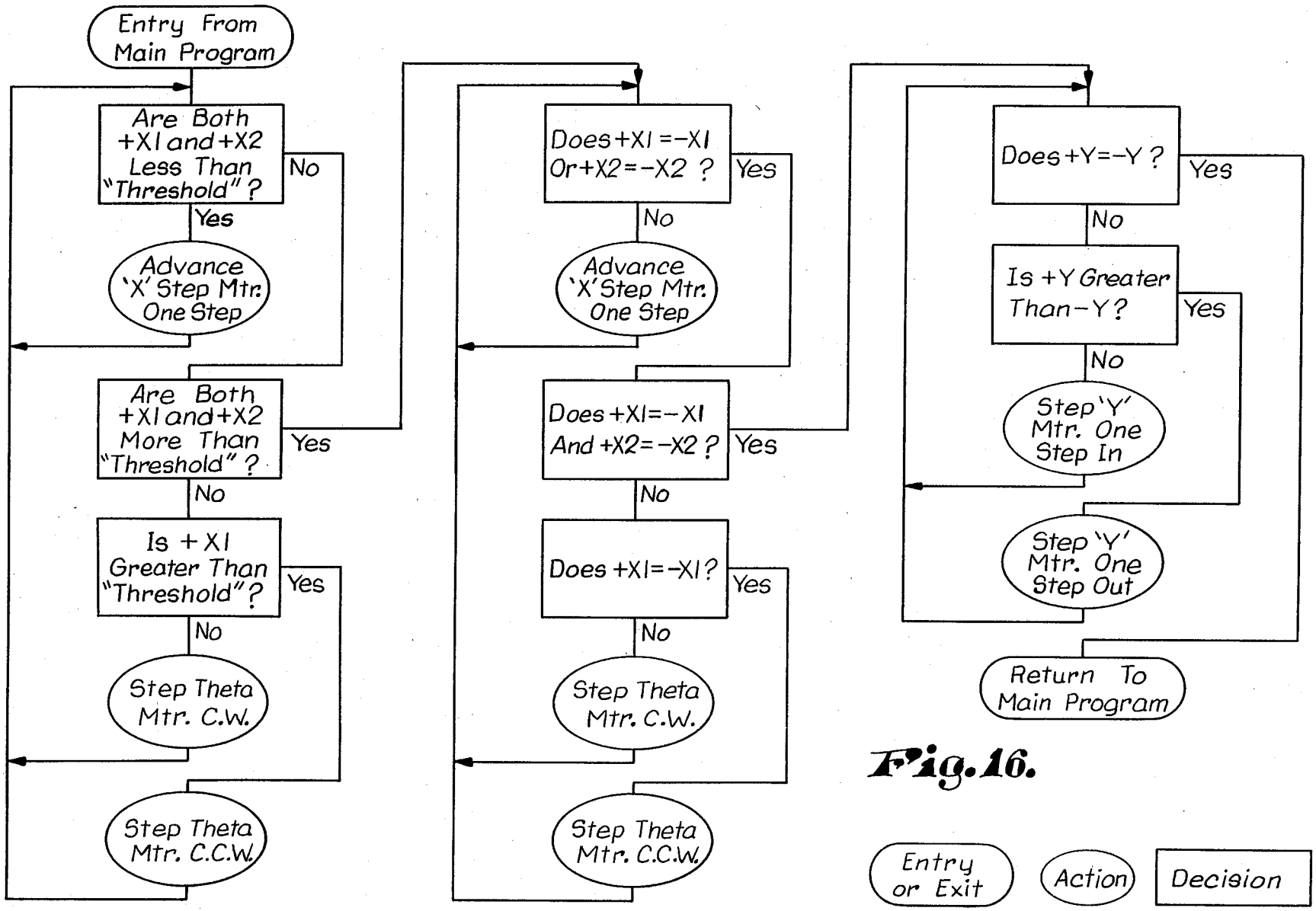
FIG. 16 is a flow chart illustrating in simplified form the manner in which the microprocessor of the present invention functions to control operation of the web advancement and die unit rotation and shifting servomotors in response to sensing of the T-shaped indicia on the web to accurately align the die unit with the next to be processed area of the web.

The phototransistors 150–156 inclusive are joined to a suitably programmed microprocessor which receives inputs from such phototransistors and issues appropriate commands to the servo-motors 72, 76, 108 and 116. The flow diagram of FIG. 16 indicates generally a suitable program sequence for the microprocessor with it being understood in this respect that the specific nature of such program may be varied depending upon an operator's processing requirements and the type of material being processed. Thus, the flow diagram of FIG. 16 is representative of an operable program and is not intended to be construed literally as the only sequence of operations which may be carried out to accomplish alignment of a defined work area of a web with the die unit 42 on an incremental basis.

OPERATION

Press 20 is especially useful for processing a web 26 having a series of images or other defined areas thereon which are to be subjected to a processing operation at the work station of the press presented by the die unit 42. The terminology "die cutting" as used herein is intended to be construed generically and to encompass various types of web processing operations which are referred to in various art recognized terms, including but not limited to stamping, cutting, punching, piercing, blanking embossing and other equivalent procedures.

Web 26 preferably has a pair of indicium 158 and 160 associated with each defined area of the web to be processed. For exemplary purposes only, web 26 has been illustrated in FIG. 8 as having a series of images 166 thereon which define the outline of the area to be subjected to a processing operation. It is to be appreciated in this respect that the design illustrated is for exemplary purposes only and that many diverse shapes may be suitably processed in press 20 using a particular die shape for the web images to be processed. However, the image 166 is typical of many designs in that it has a perimeter of irregular configuration which requires very precise alignment of the die with the edge of the design. Similarly, as shown in FIG. 7, the image to be die cut often has a series of internally located zones to be subjected to the die cutting operation including holes, slots, and larger irregularly configured areas which are to be stamped, cut, punched or embossed. FIG. 7 schematically illustrates a circuit board having slots to be die cut which are indicated by the numeral 168. Holes to be punched out for example may be of the shape denoted by the numeral 170. An irregularly shaped aperture requiring die cutting is indicated by numeral 172. Relatively small holes such as 174 and 176 respectively also require punching. In all instances, alignment of the die assembly with the portions of the image 166 to be subjected to the die cutting operation must be carried out on an extremely precise basis and preferably within a tolerance of ±0.0005 inch.

Desirably, each of the indicium 158 and 160 is of generally T-shaped configuration as best shown in FIG. 10. In actual practice, it is not necessary that each indicium be T-shaped; a right angle design is useful. However, a T-shape is preferred since web 26 needs not be run through the press 20 in a prescribed relationship in the sense of right or left-hand edges respectively. It is also to be understood that indicia other than relatively opaque marks may be used for registration purposes. Slits or holes in the web may be employed with a light source above or below the openings and sensors positioned on the opposite side of the web.

It can be seen from FIG. 10 that each of the T-shaped indicium has a section 162 extending longitudinally of the web 26 as well as a transversely extending segment 164. Each of the segments 164 is located equidistantly of the ends of a corresponding section 162 and desirably, the length of each segment 164 from the outer extremity thereof to the point of joinder of such segment with section 162 is equal to the distance from a respective end of section 162 to the point of joinder thereof with segment 164. Furthermore, the effective width of each segment 164 and associated section 162 is correlated with the distance between the center points of the exposed ends of the photo optical bundles 140–146 inclusive. Viewing FIG. 10 for example, the distance between opposed margins **164*a* and 164*b* of the section 164 is equal to the distance between the center points of the exposed ends of bundles 140 and 142. Similarly, the space between the margins 162*a* and 162*b* of section 162 of indicium 160 is equal to the distance between the center points of the exposed ends of fiber optic bundles 144 and 146. Finally, it is to be noted that the exposed ends of fiber optic bundles 140, 142 as well as 144 and 146 are located a distance such that when the bundles 144 and 146 are aligned with a section 162 in disposition such that the latter underlies an equal area of such bundles, the exposed ends of bundles 140 and 142 are located a distance from section 162 approximately one-half of a segment 164**.

Web 26 is fed to press 20 by suitable supply means and introduced into the nip between respective pairs of vertically aligned infeed rollers **70*a*–70*d* inclusive. The material is then passed between die assembly 54 and the overlying punch assembly 60. The portion of the web 26 which has been subjected to processing at the work station is then removed therefrom via the outfeed web drive mechanism 74 with the web passing between the nips of corresponding pairs of vertically aligned rollers 78*a*–78*d* inclusive. The microprocessor control of press 20 first causes the servo-drive motors 72 and 76 to operate simultaneously to move the web 26 through a given increment of travel to bring the next image 166 to be processed to the work station of the press defined by the space between die assembly 54 and punch assembly 60. The movement of the web during this time increment is relatively rapid with the fast operation of the drive motors 72 and 76 being discontinued after the next to be processed image 166 approaches a position in substantial alignment with the die assembly 54**.

Figure 12:
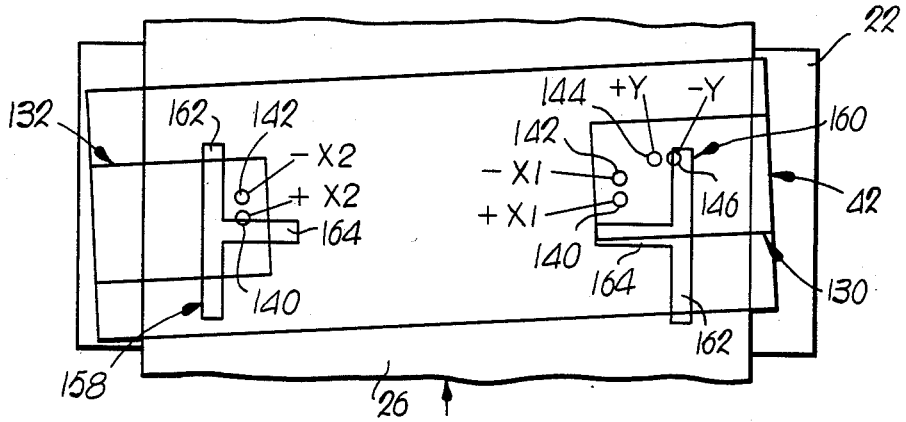
FIGS. 12–15 inclusive are schematic illustrations showing the sequence of sensing of T-shaped indicia on a web and the advancement of the web that occurs as well as the rotation and lateral shifting of the die unit effected to bring the die unit and respective associated T-shaped indicia on a web into proper registration with the sensors.
Figure 13:
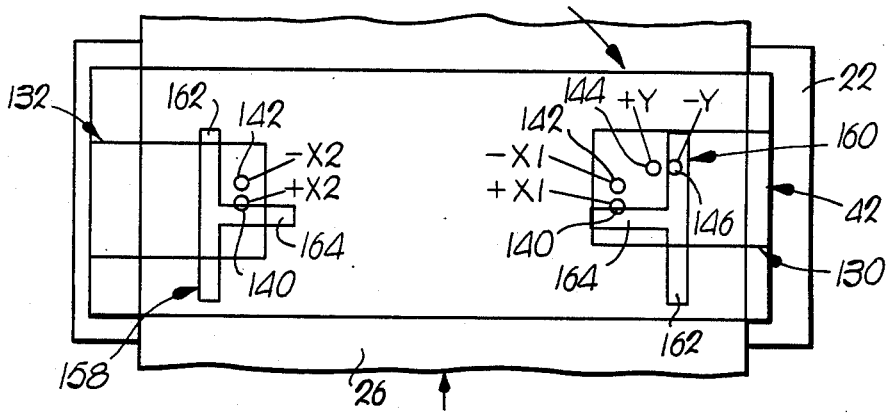

Initial setup of the machine involves programming the microprocessor (which is accomplished by a digital keyboard forming a part of the control panel of the machine) to adjust the length of time motors 72 and 76 are actuated in the full speed mode as a function of the size of the images 166 and the relative spacing therebetween as found on a particular web 26. After the web material 26 is fed a given amount adequate to bring the indicia 158 and 160 of the next to be processed image 166 into proximal relationship to sensors 130 and 132, motors 72 and 76 are then controlled by the microprocessor to operate in what may be best defined as a creep mode. The microprocessor in this instance causes the motors 72 and 76 to be incrementally actuated in a stepping fashion to move the web through successive discrete increments of 0.0005 inch. Creep of the web 26 is continued until a sensor 130 and 132 first detects a segment 164 of one of the indicium 158 or 160. In FIG. 12 for illustrative purposes only, the schematic representation indicates that the sensor 132 first senses the presence of segment 164 of indicium 158 on the left-hand side of web 26 as the latter moves upwardly in the depiction of FIG. 12. As the web 26 continues its creep mode movement, light transmitted to the surface of the web 26 by the glass fibers leading from source 148 via the bundle 140 of sensor 132 is reflected from the surface of the web, picked up by receptor fibers of the associated bundle 140 and transmitted to the respective phototransistor 150. As can be appreciated, the voltage level output of phototransistor 150 to the microprocessor is a function of and varies with the amount of light reflected back from the web 26 via glass fiber bundle 140.

Turning specific attention to the flow chart of FIG. 16, it can be seen that the creep mode initiation causes the microprocessor to enter a prescribed alignment portion of the software program which not only causes air to be directed to the bolster air bearings 98 at a prescribed time but also continues the creep mode of the motors 72 and 76 until one of the T-shaped indicia 158 or 160 is sensed by corresponding sensor 130 or 132. Thus, correlating the first step of the flow chart of FIG. 16 with the schematic representation of FIG. 12, the first phase of the alignment program involves a determination as to whether or not the amount of light reflected and sensed by the phototransistors 150 associated with sensors 130 and 132 is the same and of a maximum amount for the particular web being processed. So long as this condition exists, the motors 72 and 76 continue their creep mode advancement of 0.0005 inch steps. However, as soon as a segment 164 of one of the indicium 158 and 160 moves into disposition such that it is sensed by a bundle 140 and indicated schematically as being the left indicium 158 in FIG. 12, the amount of light reflected to an associated phototransistor 150 is less than had previously been seen by such component thus changing its voltage input to the microprocessor.

It should be explained at this juncture that during setup of the press 20 for processing each web of material, the press operator first determines the amount of light reflected from the background of the web and then causes one of the sensors 130 or 132 to read the amount of light reflected from a registration mark 158 or 160. From these readings, the microprocessor determines a so-called threshhold level for that particular job. The threshhold is computed by the microprocessor to be 80% of the difference between the amount of light reflected from a material's background as compared with the amount of light reflected from a registration mark alone.

Returning to the flow diagram of FIG. 16, so long as the readings by the phototransistors 150 connected to bundles 140 of sensors 130 and 132 are less than the defined threshhold level, the program sequence of the microcomputer continues the step by step forward advancement of DC motors 72 and 76. For simplicity purposes, the reflectance levels sensed by phototransistors 150 associated with sensors 130 and 132 are designated as +X1 and +X2, respectively, while the reflectance levels sensed by the receptors of the trailing optical bundles 142 of sensors 130 and 132 are designated by the notations −X1 and −X2. During microprocessor monitoring of the phototransistors 150 associated with the sensors 130 and 132, DC motors 72 and 76 incrementally advance the web 26 along the so-called X axis extending longitudinally of the web until there is an indication that the reflectance levels of +X1 and +X2 are both more than threshhold values. If the answer to this interrogation is yes, the microcomputer leapfrogs to another downline step of the programming sequence. However, if the answer to whether or not both +X1 and +X2 reflectance levels are more than threshhold is no, then the next step in the interrogation is whether or not the +X1 reflectance level is greater than threshhold.

If a no answer is in effect received, the microprocessor then actuates the $\theta$ DC stepper motor 116 causing the latter to advance in a clockwise direction. Comparing FIGS. 12 and 13, it is to be seen from the schematic representation that the die unit 42 is rotated by motor 116 to pivot the die unit 42, now supported by a layer of air 0.001 to 0.003 inch thick between air bearings 98 and the underlying platen 22, and thereby in effect move the receptor 140 of sensor 130 toward the adjacent segment 164 of indicia 160. As is evident from the flow diagram of FIG. 16, the microprocessor program is of the well-known loop nature such that clockwise rotation of the $\theta$ stepper motor 116 continues until microprocessor interrogation indicates that the reflectance levels X1 and X2 are both more than threshhold.

Similarly, if microprocessor interrogation as to whether or not the reflectance level of +X1 is greater than threshhold in essence establishes what amounts to a yes answer, the $\theta$ stepper motor 116 is incrementally rotated in a counterclockwise direction to rotate the die unit 42 about an upright axis therethrough until such time as the microcomputer senses that both +X1 and +X2 reflectance levels are more than threshhold.

From FIGS. 1–4 inclusive of the drawings, it can be seen that stepwise rotation of the shaft 142 of $\theta$ stepper motor 116 to rotate the shaft 124 threadably received in the block 126 which in turn is rotatably carried by U-shaped bracket 128 secured to blocks 44 and 46, causes the die unit 42 to be pivoted about the axis of support 92.

Once microprocessor interrogation of phototransistors 150 and 152 indicate that the reflectance levels of +X1 and +X2 are greater than threshhold, the microcomputer next determines whether or not +X1 equals −X1 or +X2 equals −X2. If the response amounts to a no answer, then the microcomputer causes the X-axis stepper motors 72 and 76 to advance one step. This loop is continued until the microcomputer finds that the reflectance levels of +X1 equals −X1 or the reflectance level of +X2 equals the reflectance of −X2. This step in the program is required to maintain the bundle receptor of the sensor 130 or 132 which first determines the presence of an indicium 158 or 160 in sensing relationship with such indicium as the die unit 42 is rotated about the $\theta$ axis by DC $\theta$ stepper motor 116. It can be seen from FIGS. 12 and 13 that during rotation of the die unit 42 about the axis of support 92 by actuation of the DC stepper motor 116, the sensor 132 which first sensed indicium 158 in illustrative FIG. 12 would move out of sensing relationship with the segment 164 of indicium 158 as the receptor fibers of bundle 140 of sensor 130 rotate toward the segment 164 of indicium 160, if it were not for the fact that the X-axis stepper motors 72 and 76 are actuated to continue advancement of the web 26 in an up direction viewing FIG. 12 to maintain the receptor fibers of bundle 140 of sensor 132 in sensing relationship with the segment 164 of indicium 158.

Once the microprocessor program determines that the reflectance level of +X1 equals the reflectance level −X1 or the reflectance level of +X2 equals the reflectance level −X2, then the next determination is whether the reflectance level of +X1 equals the reflectance level of −X1 and the reflectance level of +X2 equals the reflectance level of −X2.

Assuming initially that the answer to this microprocessor interrogation is no, the next step in the programming sequence is a search for whether or not the reflectance level of +X1 equals the reflectance level of −X1. If the answer is no, the $\theta$ stepper motor 116 is actuated to rotate the shaft 124 in a clockwise direction with advancement of the web by the X-axis stepper motors 72 and 76 being effected as necessary to maintain the sensor which first senses an indicium 158 or 160 in sensing relationship thereto as previously described.

If on the other hand, the interrogation by the microprocessor as to whether or not the reflectance level of +X1 equals −X1 is a yes answer, then the $\theta$-axis stepper motor 116 is actuated to cause the shaft 124 to rotate in a counterclockwise direction. Here again, the programming loop includes a sequential determination as to whether or not the reflectance level of +X1 equals the reflectance level of −X1 or the reflectance level of +X2 equals the reflectance level of −X2. If not, the X-axis stepper motors 72 and 76 are actuated as previously indicated to advance the web and maintain the sensor which first senses an indicium 158 or 160 in sensing relationship thereto.

As soon as the microprocessor program determines that the reflectance level of +X1 equals the reflectance level of −X1 and the reflectance level of +X2 equals the reflectance level of −X2, the next step is a determination as to whether or not the reflectance level of +Y equals the reflectance level of −Y. This is indicated by the schematic depiction of FIG. 14.

Figure 14:
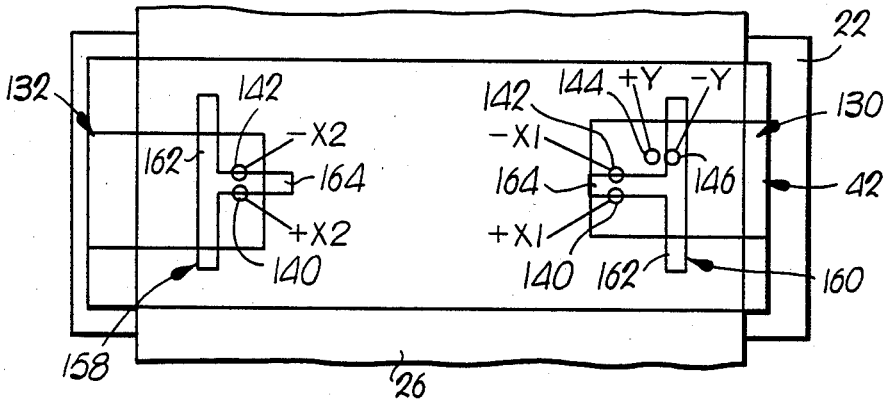

The next step in the programming sequence is to determine whether or not the indicium 158 and 160 are in proper relationship to die unit 42 in a direction transverse of web 26. For clarity purposes, this is indicated in FIG. 14 as a determination of the location of receptor fibers of bundles 144 and 146 connected to phototransistors 154 and 156 respectively relative to the elongated section 162 of a respective T-shaped indicium 158 and 160. In the depiction of FIGS. 12–15 inclusive, the sensor 130 is assumed to be the one having Y-axis sensing bundles 144 and 146 but such bundles could be provided on both of the sensors, or on the other sensor 132 if desired. As previously indicated, the section 162 is of such length that the Y-axis receptors of bundles 144 and 146 are located to determine the presence of section 162 when the receptors of bundles 140 of sensors 130 or 132 first sense the presence of a transversely extending segment 164 of indicium 158 and 160. Although as previously pointed out, the reference indicia 158 and 160 could be right angle markings rather than of Y-shaped configuration, the use of T-shaped markings permit the press operator to put the web 26 in the press without regard for a left or right side.

Viewing FIG. 4 and referring as well as to the flow diagram of FIG. 16, it is to be seen that the first microprocessor interrogation of phototransistors 154 and 156 is whether or not the reflectance level of +Y (sensed by the fiber receptors of bundle 144) equals a reflectance level of −Y (sensed by the receptor fibers of bundle 146). If the answer to this interrogation is a no, then the next program interrogation is whether or not the reflectance level of +Y is greater than the reflectance level of −Y. If the answer to this interrogation is yes as for example indicated schematically in FIG. 14, the Y-axis stepper motor 108 is actuated to rotate the shaft 112 thereof in a direction to move the block 90 and thereby die unit 42 connected thereto one step inwardly. The loop is continued until such time as the microprocessor determines that the reflectance level of +Y equal the reflectance level of −Y.

Figure 15:
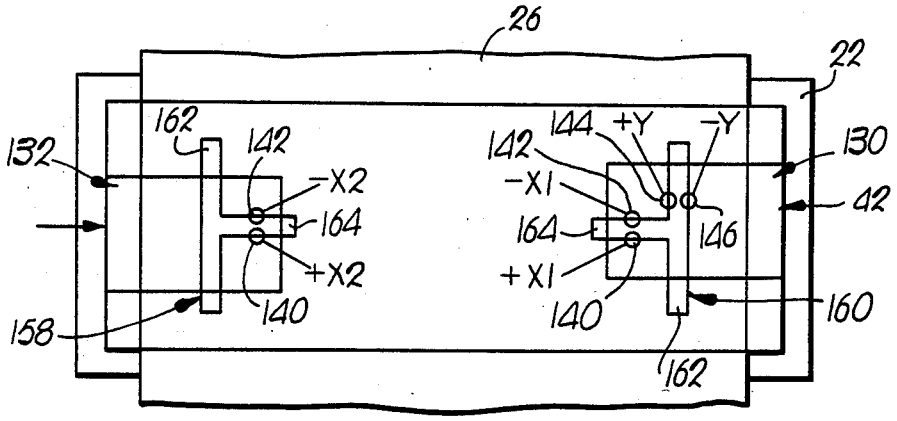

If the interrogation as to whether or not the reflectance level of +Y is greater than the reflectance level of −Y is a no answer, then stepper motor 108 is actuated to rotate shaft 112 in a direction to move the block 90 and associated die unit 42 one step in. The loop is repeated as previously described until the microprocessor program determines that the +Y reflectance level is equal to the −Y reflectance level as illustrated in FIG. 15, whereupon the microprocessor returns to its main program resulting in deactivation of air delivery to the air bearings 98 and operation of the piston and cylinder assembly 38 to bring the die assembly 54 and punch assembly 60 into functional engagement with web 26.

ALTERNATE EMBODIMENT

In FIG. 11, an alternate sensor **130*a* is depicted which differs from the sensor 130 for example in the provision of photoelectrical devices 178*a–d* inclusive which are carried by the underside of the block 138 in disposition to sense the presence of an indicium 158 or 160 in a manner similar to the operation of sensors 130 and 132 along with associated phototransistors 150–156 inclusive. In the case of photoelectric devices 178*a–d* inclusive, a remote light source and phototransistors receiving light inputs from glass fiber bundles is avoided by placement of the light emitting devices and light sensors directly in the sensing head itself for positioning in close proximity to the web 26 as the latter moves through the work station of press 20. By positioning the devices 178*a* to 178*d* in a line at a 45° angle with respect to the longitudinal axis of section 162 and segment 164 of the indicium 160**, the same sensing of the presence of a mark may be carried out as previously described using essentially the same program for the microprocessor control.

We claim:

1. A die cutting press for web material having indicia on opposite, longitudinally extending sides thereof associated with each defined area of the web to be die cut, the indicia on opposed sides of the web which are related to a particular defined web area each being provided with a segment which extends transversely of the web and at least one of the opposed, related indicia having a section disposed longitudinally of the web, said press comprising:

a base platen defining a web material work station;

means for mounting a die unit on the base platen below said power operated means in disposition for rotation about an upright axis and shifting of the die unit in a direction at least transversely of the path of travel of a web through the press;

means for effecting rotation of the die unit on said base platen;

power operated means shiftable toward and away from said platen;

web backup means carried by the power operated means cooperable with the die unit to present a web processing work station therebetween;

means for shifting the die unit transversely of an area of the web situated at said press work station;

means for feeding the web material on an incremental basis to sequentially position successive defined areas of the web at said press work station;

first sensing means movable with the die unit and having sensors positionable to sense the presence of indicia on opposite sides of web at said work station, said first sensing means being operable to determine the presence of a segment of an indicium which first presents itself to said first sensing means as the web is moved by the feeding means through a displacement to bring the next defined area of the web to said press work station;

means controlled by said first sensing means and coupled to said web feeding means and to said die unit rotating means for effecting rotation of the die unit to an extent as may be necessary and in a direction to bring the segment of the opposed indicium related to be indicium segment first sensed by said first sensing means during movement of a particular defined area of the web to the press work station, into a location where such opposed, related segment is sensed as being present by the first sensing means, while continuing operation of the web feeding means to move the web longitudinally of the length thereof as may be necessary to maintain the presence sensing relationship between the first sensing means and the segment of the indicium which was first sensed by first sensing means as said next defined area of the web is moved to the press work station;

second sensing means movable with the die unit and having sensors positionable to sense the presence and relative position to the second sensing means of the indicium section associated with a respective defined area of the web; and means controlled by said second sensing means and coupled to said die unit shifting means for effecting shifting of the die unit transversely of a respective defined area of the web to an extent as may be necessary to bring the section of a corresponding indicium into predetermined relative relationship to said second sensing means whereby the die unit is accurately positioned with respect to each defined area of the web moved into the press work station; and means for actuating the power operated means only after accurate positioning of a defined area of the web at said press work station has occurred.

2. A die cutting press as set forth in claim 1, wherein said indicia sensing means includes photooptical devices.

3. A die cutting press as set forth in claim 1, wherein is provided means for supporting the die unit on a cushion of air as the die unit is rotated about said upright axis.

4. A die cutting press as set forth in claim 1, wherein is provided means for supporting the die unit on a cushion of air as the die unit is shifted in a direction transversely of the web.

5. A die cutting press as set forth in either of claims 3 or 4, wherein said air cushion providing means is operable to provide said cushion of air between the die unit and said base platen.

6. A die cutting press as set forth in claim 3, wherein said die unit mounting means includes a rotatable support member carried by the base platen and engaging the die unit for restricting movement of the latter to rotation about said upright axis while the die unit is supported by said cushion of air.

7. A die cutting press as set forth in claim 6, wherein said rotatable support member is movable to a limited extent along the axis of rotation thereof while preventing lateral shifting the die unit.

8. A die cutting press as set forth in claim 4, wherein said die unit mounting means includes a channel-defining element carried by the base platen with the channel portion thereof oriented in a direction transverse of the path of travel of said web through the press, and a member coupled to the die unit and shiftable in said element with the direction of movement of the member and thereby the die unit being restricted by said element.

9. A die cutting press as set forth in claim 1, wherein said die unit mounting means includes a rotatable support member coupled to the die unit, a channel-defining element carried by the base platen with the channel portion thereof oriented in a direction transverse of the path of travel of said web through the press, and a block shiftably mounted in the channel portion of said element and supporting said member for rotation about said upright axis.

10. A die cutting press as set forth in claim 9, wherein said rotatable support member is movable to a limited extent along the axis of rotation thereof while preventing lateral shifting the die unit, there being selectively operable means for supporting the die unit on a cushion of air as the die unit is rotated about said upright axis.

11. A die cutting press as set forth in claim 10, wherein is provided three separate servomotors individually operable to advance the web toward said work station, effect rotation of the die unit, and cause shifting of the latter laterally of the web while supported on said cushion of air.

12. A die cutting press as set forth in claim 1, wherein said first sensing means includes a support coupled to said die unit adjacent the work station, means carried by said support for receiving and then conveying an indication of the amount of light reflected from a predetermined area of a web positioned at said work station to a location remote from the work station, and means responsive to said indication of the amount of light received at said remote location for sensing the presence or absence of an indicium on said web.

13. A die cutting press as set forth in claim 1, wherein said second sensing means includes a support coupled to said die unit adjacent the work station, means carried by said support for receiving and then conveying an indication of the amount of light reflected from a predetermined area of a web positioned at said work station to a location remote from the work station, and means responsive to said indication of the amount of light received at said remote location for sensing the presence or absence of an indicium on said web.

14. A die cutting press as set forth in claims 12 or 13, wherein said light receiving and conveying means comprises a bundle of flexible light transmitting glass fibers.

15. A die cutting press as set forth in claim 14, wherein said light receiving and conveying means also includes a series of flexible light transmitting fibers for transmitting light from said location to said work station for reflection from the web and conveyance of at least a portion thereof back to the location via said bundle of light transmitting glass fibers.

16. A die cutting press as set forth in claims 12 or 13, wherein said light receiving and conveying means comprises two separate units terminating in receptors adapted to be located adjacent the web in disposition to sense passage of an indicium therebetween, the receptors being spaced a distance such that a substantially equal amount of reflected light in received by each receptor of the pair thereof when a corresponding indicium is equidistantly positioned with respect to said pair of said receptors.

17. A die cutting press as set forth in claim 1 for use in processing web material wherein the segment and section making up one indicium on one side of the web each have opposed margins disposed such that bisecting imaginary lines therebetween are essentially at right angles to one another, and wherein said first and second sensing means each include a support coupled to the die unit adjacent the work station, means carried by a respective support for receiving and conveying an indication of the amount of light reflected from predetermined corresponding areas of a web positioned at said work station to a location remote from the work station, and separate means responsive to said indication of the amount of light received at each of said remote locations for sensing the presence or absence of a segment or section respectively of the indicia sensed thereby.

18. A die cutting press as set forth in claim 17, wherein said light receiving and conveying means each comprise two separate units terminating in receptors and adapted to be located adjacent the web in disposition to sense the presence or absence of a respective segment or section of said one indicium on one side of the web, each of the pair of associated receptors being located such that an imaginary line therebetween is in perpendicular relationship to a respective imaginary line bisecting a corresponding section or segment of said one indicium.

19. A die cutting press as set forth in claim 18, wherein each of said receptors is a bundle of flexible, light transmitting glass fibers, the bundles terminating in light receiving relationship at extremities all of which lie in essentially a common plane parallel to a plane through the upper surface of a defined area of the web at said press work station.

20. A die cutting press as set forth in claim 19, wherein said separate light responsive means each comprise a phototransistor.

* * * * *